United States Patent [19]

Hirata

[11] 4,273,958

[45] Jun. 16, 1981

[54] QUADRATURE RECEIVER

[75] Inventor: Hitoshi Hirata, Tokyo, Japan

[73] Assignee: Pioneer Electronic Corporation, Tokyo, Japan

[21] Appl. No.: 98,284

[22] Filed: Nov. 28, 1979

[30] Foreign Application Priority Data

Dec. 1, 1978 [JP] Japan ..... 53-149482

[51] Int. Cl.[3] ..... H04H 5/00

[52] U.S. Cl. ..... 179/1 GS; 455/260

[58] Field of Search ..... 179/1 GS; 455/260, 259, 455/258, 256

[56] References Cited

U.S. PATENT DOCUMENTS 3,769,589 10/1973 Buntschuh et al. ..... 455/260

4,035,833 7/1977 Shepard ..... 455/260

4,215,316 7/1980 Yamaguchi et al. ..... 179/1 GS

*Primary Examiner*—Douglas W. Olms

*Attorney, Agent, or Firm*—Sughrue, Rothwell, Mion, Zinn and Macpeak

[57] ABSTRACT

A quadrature receiver circuit in which the output frequency of a local oscillator is controlled to follow the free-running frequency of a voltage-controlled oscillator so that accurate four-phase demodulation is maintained independent of oscillator drift. The output control voltage of a phase comparator in a phase-locked loop circuit in the demodulator is coupled through a low-pass filter and a DC amplifier to the frequency control input of a voltage controlled local oscillator.

6 Claims, 3 Drawing Figures

QUADRATURE RECEIVER

BACKGROUND OF THE INVENTION

This invention relates to phase control device. More particularly, the invention relates to a received signal phase control device which is employed as the demodulation circuit of a compatible quadrature AM stereophonic signal, that is, one which is compatible with a stereophonic signal receiver and a monaural signal receiver.

One of the stereophonic signals in a compatible quadrature PM system is an AM stereophonic signal. Such a stereophonic signal $e_i$ can be represented by the following equation (1):

$$e_1=[\{1+k(L(t)+R(t))\}\cdot\cos\omega_i t+k\{L(t)-R(t)\}\cdot\cos(\omega_i t+\pi/2)]\cdot\cos\phi, \quad (1)$$

where $\phi=\tan^{-1}k\{L(t)-R(t)\}/[1+k\{L(t)+R(t)\}]$, L(t) and R(t) are the left and right channels signals, $\omega_i$ is the angular frequency of the carrier signal, and k is the modulation factor.

That is, the compatible quandrature AM stereophonic signal is produced by synthesizing a signal which is obtained by modulating the amplitude of the carrier signal $\cos\omega_i t$ with a signal corresponding to the sum of the two channel signals and another signal which is obtained by modulating the carrier signal $\cos(\omega_i t+\lambda/2)$, which is shifted by 90° in phase with respect to the aforementioned carrier signal, with a signal corresponding to the difference between the two channel signals. The synthesized signal is transmitted with the level being modulated with $\cos\phi$ as indicated in the equation (1) so that the stereophonic signal can be received by a monaural signal receiver.

A second type of stereophonic signal can be represented by the following equation:

$$e_i = [\{1 + kL(t)\} \cdot \cos(\omega_i t + \pi/4) + \{1 + kR(t)\} \cdot \omega_s(\omega_i t - \pi/4)] \cdot \cos\phi \sqrt{2}\,. \quad (2)$$

A stereophonic signal of the form indicated by the equation (2) can be demodulated by a circuit as shown in FIG. 1. A received input signal is mixed with a local oscillation signal $e_L$ produced by a local oscillator in a mixer 2 as a result of which an intermediate frequency signal $e_i$ is obtained. The intermediate frequency signal, after being amplified by an IF amplifier 3, is applied to a divider 4.

In the divider 4, the $\cos\phi$ component is removed from the intermediate frequency signal $e_i$ and the resulting signal is applied to a quadrature stereophonic demodulation circuit 5. In this demodulation circuit 5, a differential circuit-type product demodulator is employed to produce products of the output of the divider 4 and signal components $\cos(\omega_i t+\pi/4)$ and $\cos(\omega_i t-\pi/4)$, the product output signals being the signal components L(t) and R(t).

In order to produce the signal components $\cos\phi$, $\cos(\omega_i t+\pi/4)$ and $\cos(\omega_i t-\pi/4)$ for use in this demodulation circuit, a phase-locked loop (PLL) circuit 10 and phase shifters are used. That is, the intermediate frequency signal $e_i$, after being converted into a square-wave signal by a limiter 6, is applied to one input of a phase comparator 7. The output of the phase comparator 7 is applied through a low-pass filter (LPF) 8 to a DC amplifier 9 where it is amplified and is then applied as a control voltage to a voltage-controlled oscillator (VCO) 11. The output $e_o$ of the voltage-controlled oscillator 11 is applied to the other input of the phase comparator 7 and an error voltage $V_1$ corresponding to the frequency of the aforementioned input $e_i$ and the phase difference between the two inputs is thereby formed at the output of the phase comparator 7, The output $e_o$ of the voltage-controlled oscillator 11 is applied to one input terminal of an in-phase detector 13 after being phase shifted 90° by a $\pi/2$ phase shifter 12. The intermediate frequency signal $e_i$ is applied to the other input terminal of the in-phase detector 13 from which the latter produces the component $\cos\phi$ which is applied to the divider 4.

The output of the $\pi/2$ phase shifter 12 is shifted in phase by ±45° by a $\pi/4$ phase shifter 14 and a $\pi/4$ phase shifter 15 so that the components $\cos(\omega_i t+\pi/4)$ and $\cos(\omega_i t-\pi/4)$ are produced thereby after which they are applied to the quadrature demodulation circuit 5.

In the case where the phase comparator 7 in the PLL circuit 10 provides the output voltage $V_1$ proportional to the cosine of the phase difference between the two input signals, the phase difference $\Delta\Phi_e$ between the two input signals can be represented by the following equation (3):

$$\Delta\Phi_e=\cos^{-1}\Delta\omega/Kd, \quad (3)$$

where Kd is the loop gain of the PLL circuit, and $\Delta\omega$ is the difference between the angular frequency $\omega_i$ of the input signal $e_i$ and the free-running frequency $\omega_o$ of the voltage-controlled oscillator 11.

Thus, as is clear from the equation (3), when $\Delta\omega$ is zero, that is, when the input signal $e_i$ is equal to the free-running frequency of the voltage-controlled oscillator 11, $\Delta\Phi_e$ is 90° and the phase of the output $e_o$ of the voltage-controlled oscillator 11 is shifted by 90° from the phase of the input signal $e_i$. The signal components $\cos\phi$, $\cos(\omega_i t+\pi/4)$ and $\cos(\omega_i t-\pi/4)$ obtained with use of the signal $e_o$ have regular phases and therefore correct quadrature stereophonic demodulation can be performed.

However, if for instance the frequency of the local oscillation signal $e_L$ is slightly shifted due to temperature drift or the like, the frequency of the intermediate frequency signal $e_i$ also shifts as a result of which the value $\Delta\omega$ in the equation (3) will not be zero. In this case, the phase difference $\Delta\Phi_e$ between the signal $e_i$ and the output signal $e_o$ of the voltage-controlled oscillator 11 varies with the value $\Delta\omega$ as is clear from the equation (3) and the relation between them is as indicated by the solid line in FIG. 2.

It is known in the art that when the free-running frequency of the voltage-controlled oscillator is different from the frequency of the input signal $e_i$, the output of the voltage-controlled oscillator 11 is locked to follow the input signal frequency but that the phase thereof is locked with a predetermined amount of shift $\Delta\Phi_e$ from the phase of the input signal $e_i$. Therefore, although it is desired to obtain as the output of the voltage-controlled oscillator a signal $e_o$ whose phase is shifted exactly by 90° from that of the input signal $e_i$, the phase is actually shifted by some value of $90°\pm\alpha$. Thus, correct quadrature demodulation cannot be achieved.

Accordingly, an object of this invention is to provide a phase control device in which control is effected so that the phase of the output signal of the voltage-controlled oscillator in the PLL circuit is shifted by a constant predetermined amount (90°) from that of the input signal.

SUMMARY OF THE INVENTION

The phase control device of the invention utilizes the fact that the voltage $V_1$ proportional to the phase difference between the two input signals to the phase comparator in the PLL circuit is provided as the output voltage of the comparator. The oscillation frequency of the local oscillator is controlled by the voltage $V_1$ so that the frequency of the output of the mixer, that is, the frequency of the intermediate frequency signal is identical to the free-running frequency of the voltage-controlled oscillator.

DESCRIPTION OF THE PREFERRED EMBODIMENTS

Figure 1:
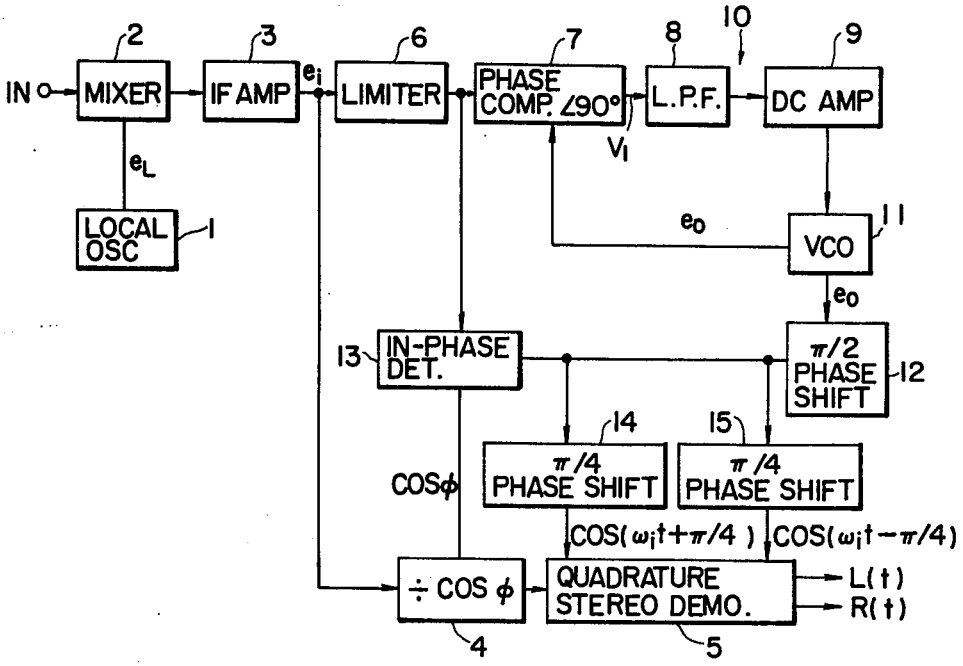
FIG. 1 PRIOR ART
FIG. 1 is a block diagram showing a part of a conventional compatible quadrature AM stereophonic signal receiver.
Figure 3:
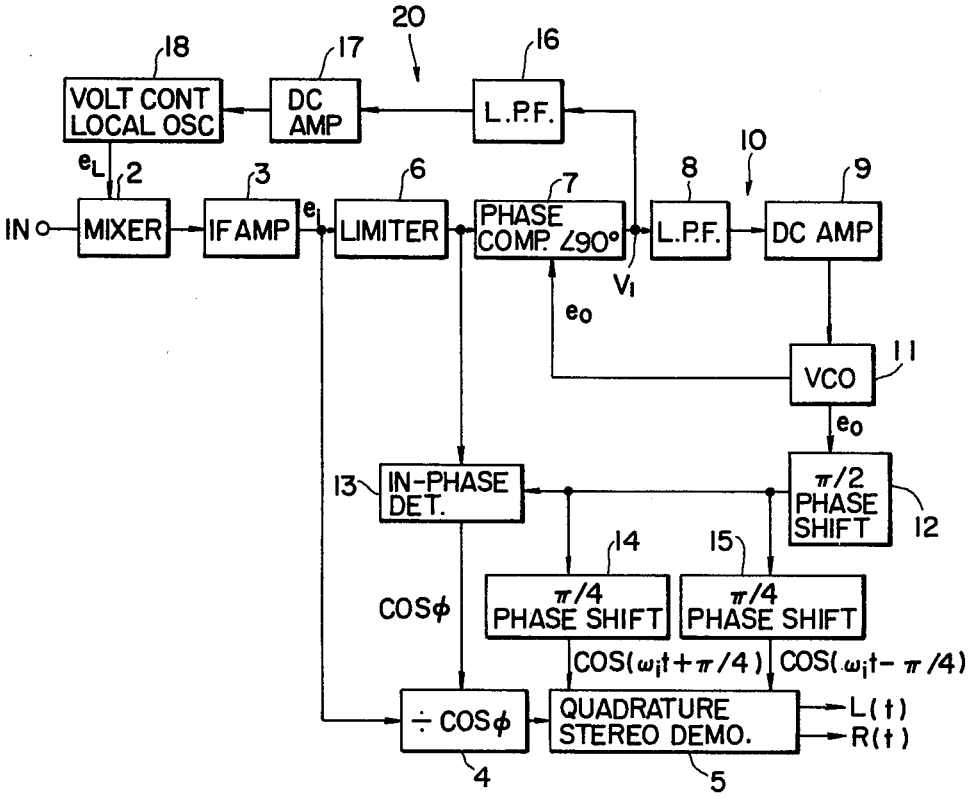
FIG. 3 is a block diagram showing a part of a compatible quadrature AM stereophonic signal receiver employing a phase control device according to the invention.

A preferred embodiment of the invention will be described with reference to FIG. 3 which shows one example of a phase control device according to the invention. In FIG. 3 those components which have been previously described with reference to FIG. 1 are therefore similarly numbered. Only components in FIG. 3 different from those in FIG. 1 will be described.

The output $V_1$ of the phase comparator 7 in the PLL circuit 10 is applied through a low-pass filter (LPF) 16 and a DC amplifier 17 to a voltage-controlled local oscillator 18. That is, the output $V_1$ is employed as the oscillation signal signal of the voltage controlled local oscillator 18. These elements form an automatic phase control (APC) circuit 20. If, in this connection, for instance a varactor diode is employed in the local oscillator, then the local oscillation frequency can be varied by applying the output voltage of the DC amplifier 17 across the diode. It is necessary that the loop gain of the APC circuit 20 be much greater than that of the PLL 10.

The output voltage $V_1$ of the comparator 7 is a difference voltage proportional to the phase difference between the input signal $e_i$ and the output $e_o$ of the voltage-controlled oscillator 11. Therefore, if the oscillation frequency of the voltage-controlled local oscillator 18 is controlled in accordance with the voltage $V_1$, then the frequency of the intermediate frequency signal $e_i$ will be made equal to the free-running frequency of the voltage-controlled oscillator 11.

Therefore, even when the frequency of the intermediate frequency signal $e_i$ is changed by temperature drift or the like becoming different from the free-running frequency of the voltage-controlled oscillator 11, the frequency of the intermediate frequency signal $e_i$ is made equal to the free-running frequency because the frequency of the local oscillation signal is controlled by the output voltage of the phase comparator 7. Thus, the phase difference between the output $e_o$ of the voltage-controlled oscillator 11 and the input signal $e_i$ is maintained at 90° at all times and therefore the quadrature stereophonic demodulation operation is carried out accurately.

Figure 2:
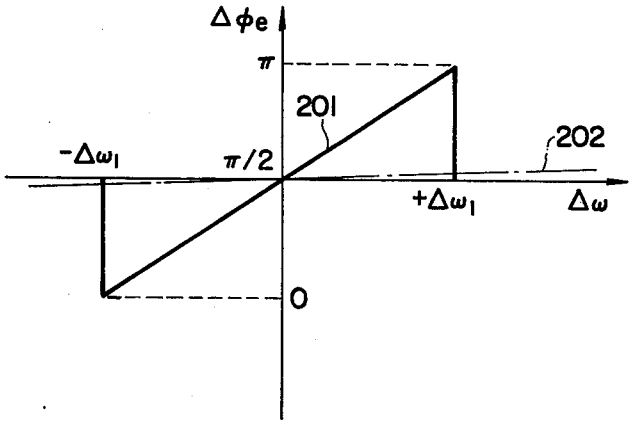
FIG. 2 is a diagram used for comparing the characteristics of the circuit shown in FIG. 1 with those of a phase control device according to the present invention.

The relation between the frequency difference $\Delta\omega$ and the phase difference $\Delta\Phi_e$ is as indicated by the dot-chain line in FIG. 2. In this figure, frequencies in the input signal frequency range corresponding to $|\Delta\omega_1|$ are the lock range of the PLL circuit 10. With the arrangement shown in FIG. 3, the PLL circuit 10 can be locked even if the lock range of the conventional PLL circuit is exceeded. Thus, the lock range of the PLL circuit is effectively increased.

As is clear from the above description, according to the invention, the intermediate frequency in the quadrature AM stereophonic signal receiver is controlled to be equal to the free-running frequency of the voltage-controlled oscillator in the PLL circuit whereby the output of the voltage-controlled oscillator is maintained shifted by 90° from the input signal or the intermediate frequency signal at all times. Thus, the invention is meritorious in that the demodulation is properly carried out and the lock range of the PLL circuit is increased.

What is claimed is:

1. A quadrature receiver circuit for a signal receiver comprising: means for producing a local oscillation signal; a mixer circuit for mixing a predetermined input signal with said local oscillation signal; a voltage-controlled oscillator circuit whose oscillation frequency is varied in accordance with a control signal; and a phase comparator circuit adapted to compare the phase of an output of said voltage-controlled oscillator circuit with the phase of an output of said mixer circuit to provide said control signal having a parameter which varies in accordance with the resultant phase difference, said means for producing said local oscillation signal being controlled by said control signal so that an output frequency of said mixer circuit is equal to the free-running frequency of said voltage-controlled oscillator circuit.

2. The quadrature receiver circuit of claim 1 further comprising: a low pass filter having an input coupled to said output of said voltage-controlled oscillator circuit and a DC amplifier having an input coupled to an output of said low pass filter and an output coupled to a control input of said means for producing said local oscillation signal.

3. The quadrature receiver circuit of claim 2 wherein said means for producing a local oscillation signal comprises a varactor diode.

4. A quadrature stereophonic receiver circuit comprising: means for producing a local oscillation signal, means for mixing said local oscillation signal with a received signal to produce an intermediate frequency signal, a phase-locked loop circuit including means for comparing the phase of said intermediate frequency signal with an output signal of a voltage-controlled oscillator of said phase-locked loop, and means for controlling the frequency of said local oscillation signal in response to an output signal of said phase comparing means.

5. The quadrature receiver circuit of claim 4 further comprising quadrature stereophonic detector means.

6. The quadrature stereophonic receiver circuit of either claim 4 or 5 wherein said controlling means comprises a low pass filter means having an input coupled to receive said output signal of said voltage-controlled oscillator and a DC amplifier having an input coupled to an output of said low pass filter means, and wherein said means for producing a local oscillation signal has a frequency control input coupled to an output signal of said DC amplifier.

* * * * *